US006721433B2

(12) United States Patent
Sato

(10) Patent No.: US 6,721,433 B2
(45) Date of Patent: Apr. 13, 2004

(54) ACOUSTIC APPARATUS WEARABLE ON THE HEAD

(75) Inventor: Toshiaki Sato, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/123,462

(22) Filed: Apr. 15, 2002

(65) Prior Publication Data

US 2002/0168081 A1 Nov. 14, 2002

(30) Foreign Application Priority Data

Apr. 16, 2001 (JP) ..... 2001-116602

(51) Int. Cl.[7] ..... H04R 25/00

(52) U.S. Cl. ..... 381/379; 381/370; 381/374; 381/381; 181/128; 181/135

(58) Field of Search ..... 381/379, 370, 381/374, 378, 380, 381; 181/135, 130, 128, 126

(56) References Cited

U.S. PATENT DOCUMENTS 6,178,251 B1 * 1/2001 Luchs et al. ..... 381/364

6,456,721 B1 * 9/2002 Fukuda ..... 381/380

* cited by examiner

*Primary Examiner*—Curtis Kuntz
*Assistant Examiner*—Tuân D Nguyêñ
(74) *Attorney, Agent, or Firm*—Frommer Lawrence & Haug LLP; William S. Frommer; Leonard J. Santisi

(57) ABSTRACT

To both ends of a frame constituting a lateral pressure structure of headphones, support sections functioning as fine adjustment members for performing fine adjustments to the lateral pressure structure are attached. Paddings are provided on one of the ends of the support sections. When the headphones are worn, the paddings come into contact with a user's head. Earphone arm support sections are provided towards the tip of both ends of the frame, and earphone arms are rotatably connected to each of the earphone arm support sections. Earphone capsule sections are provided at the ends of the earphone arms. When external sounds need to be heard temporarily, the earphone capsule section can be released from the user's ear by rotating the earphone arm while the headphones are still worn on the head.

5 Claims, 8 Drawing Sheets

ACOUSTIC APPARATUS WEARABLE ON THE HEAD

CROSS REFERENCE TO RELATED APPLICATIONS

The present document is based on Japanese Priority Document JP 2001-116602, filed in the Japanese Patent Office on Apr. 16, 2001, the entire contents of which are incorporated herein by reference to the extent permitted by law.

BACKGROUND OF THE INVENTION

1. Field of the Invention

The present invention generally relates to an acoustic apparatus for listening to audio, and specifically relates to a construction of an acoustic apparatus worn on the head.

2. Description of the Related Art

Conventional acoustic apparatuses for listening to audio while worn close to the human ear include earphones (hereinafter referred to as a first type of acoustic apparatus) which are individually inserted in both ears, headphones (hereinafter referred to as a second type of acoustic apparatus) which cover both ears entirely with both ends of a U-shaped elastic frame, flat earphones (hereinafter referred to as a third type of acoustic apparatus) to which curved ear-hooking sections are attached and which are pressed against the pinnae of both ears individually.

Of these acoustic apparatuses, in the first type of acoustic apparatus, earphones are merely inserted in the ears and are thus generally prone to falling out of the ear. Inserting the earphones firmly in order to prevent them from falling out will cause pain when used over extended periods. In addition, because the shape and size of the ear vary from person to person, some users may not be able to wear the earphones properly.

In the second type of acoustic apparatus (headphones), both ears are entirely covered by way of pressure exerted by the elastic frame constituting a lateral pressure structure, and thus may cause discomfort. In addition, there is a problem in that depending on the user's head-size or width, the pressure differs, and the fit thus differs from user to user. Further, because the sections which cover the ears obstruct the passage of riding bows of glasses, in some cases, the headphones will need to be removed when wearing spectacles which are put on and taken off relatively frequently such as far-sighted glasses, reading glasses, or sunglasses. The second type of acoustic apparatus is thus tedious and inconvenient to use when used in conjunction with spectacles which are put on and taken off relatively frequently such as far-sighted glasses, reading glasses, or sunglasses.

In the third type of acoustic apparatus, there is a problem in that the apparatus puts a burden on the user's ears, and as with the second type of acoustic apparatus, the ear-hooking sections obstruct the passage of riding bows of glasses.

Further, conventionally, when using a telephone, or when the user is spoken to while wearing an acoustic apparatus, there are cases in which the user would want to temporarily release the acoustic apparatus from one ear in order to listen to external sounds. In such cases, with the first type and the third type of acoustic apparatuses, taking out one of the earphones is easy, but the earphone which has been taken out will dangle due to gravity and will be in the way, and in the case of stereo models, the weight of the earphone that has been taken out may cause the other earphone to fall out. In such a case, the dangling earphone may become caught in some object, possibly resulting in wire breakage. Further, with the second type of acoustic apparatus, every time the user uses a telephone, or when the user is spoken to, the headphones need to be removed entirely, thus requiring a tedious operation on the part of the user.

SUMMARY OF THE INVENTION

It is an aspect of the present invention to provide an improvement on the second type of acoustic apparatus, and to provide an acoustic apparatus having a novel structure which enables fine adjustment of the lateral pressure structure by the user so as to optimize its fit for the user.

Another aspect of the present invention is to provide an acoustic apparatus with a novel structure which does not obstruct the wearing or taking off of spectacles even while the acoustic apparatus is worn on the head.

Yet another aspect of the present invention is to provide an acoustic apparatus with a novel structure which enables releasing the acoustic apparatus from the ears temporarily (one at a time, or both at the same time) while the acoustic apparatus is worn on the head.

An acoustic apparatus according to an embodiment of the present invention comprises a frame member forming a lateral pressure structure, fine adjustment members which are provided on both ends of the frame member and perform fine adjustments to the lateral pressure structure, padding members which are attached to the fine adjustment members and come in contact with the surface of the head, and a sound outputting section which is installed to at least one end of the frame member.

With the construction described above, the user can perform fine adjustments to the lateral pressure of the lateral pressure structure using the fine adjustment members. A comfortable fit can thus be achieved, catering to each user's head shape and fitting preferences during use of the apparatus.

Further, this acoustic apparatus can be worn without having the frame member and the fine adjustment member touch the pinnae or bases of the user's ears. Therefore, it is not obstructive even during use of equipments which are frequently put on or taken off such as sunglasses and other viewing aids such as spectacles and reading glasses.

The fine adjustment member comprises, for example, at least one rod-shaped member, which possesses flexibility and plasticity, one end of which is joined to the frame member, and the other end to the padding member. Alternatively, the fine adjustment member may comprise two rod-shaped members, which possess flexibility and plasticity, and are joined to the frame member on one side, and to the padding member on the other side.

BRIEF DESCRIPTION OF THE DRAWINGS

The above and other aspects, features and advantages of the present invention will become more apparent to those skilled in the art from the following description of the presently preferred exemplary embodiments of the invention taken in conjunction with the accompanying drawings, in which.

DESCRIPTION OF THE PREFERRED EMBODIMENTS

Below, headphones as an acoustic apparatus wearable on the head according to an embodiment of the present invention are described in detail with reference to the accompanying drawings. In the present patent specification, the term "headphones" refers to any equipment which is worn on the head in order to listen to audio, and includes receivers for cellular phones, and various receivers for performing voice activated operations. Further, as mentioned later, it also includes any such equipment which is combined with other equipments such as glasses.

Figure 1:
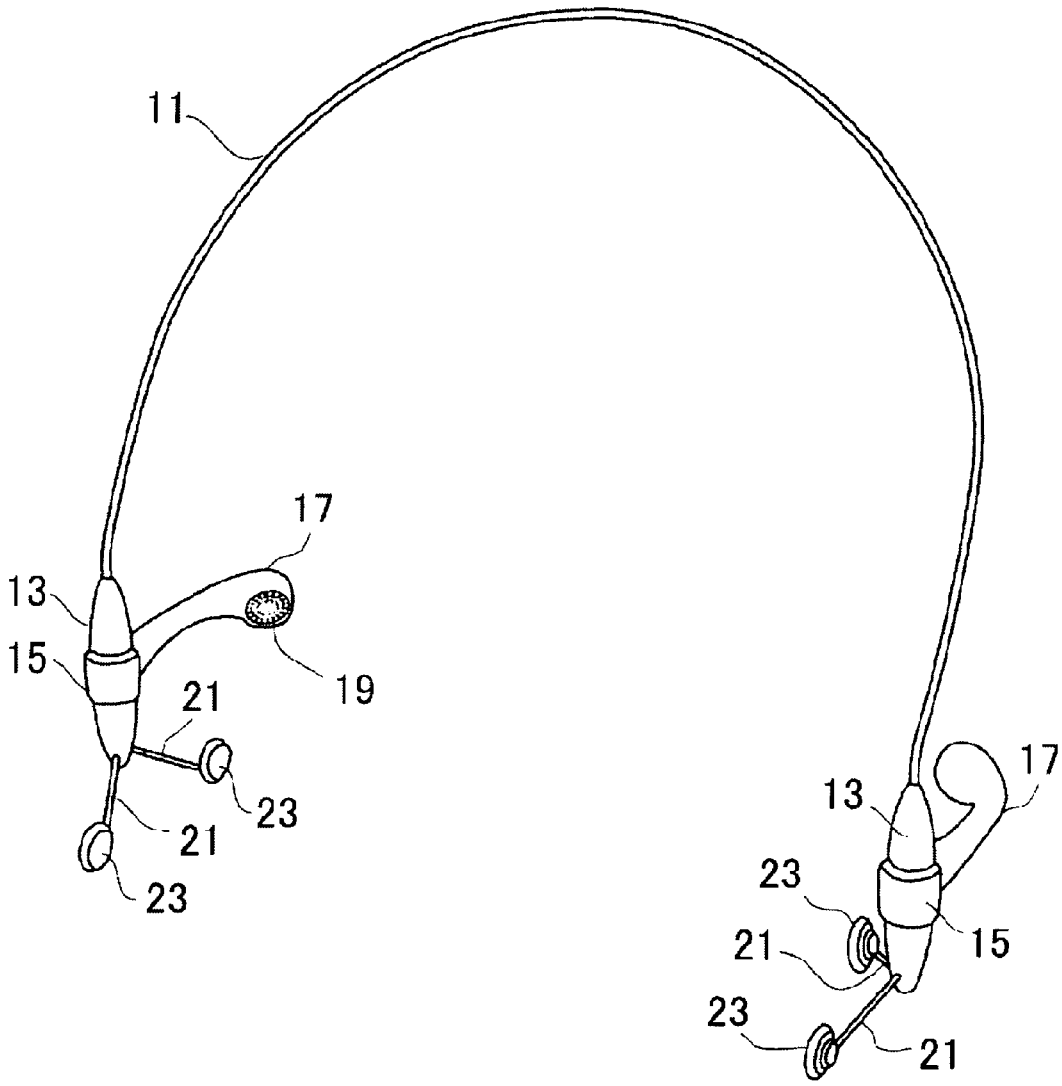
FIG. 1 is a perspective view of headphones according to a first embodiment of the present invention.
Figure 2A:
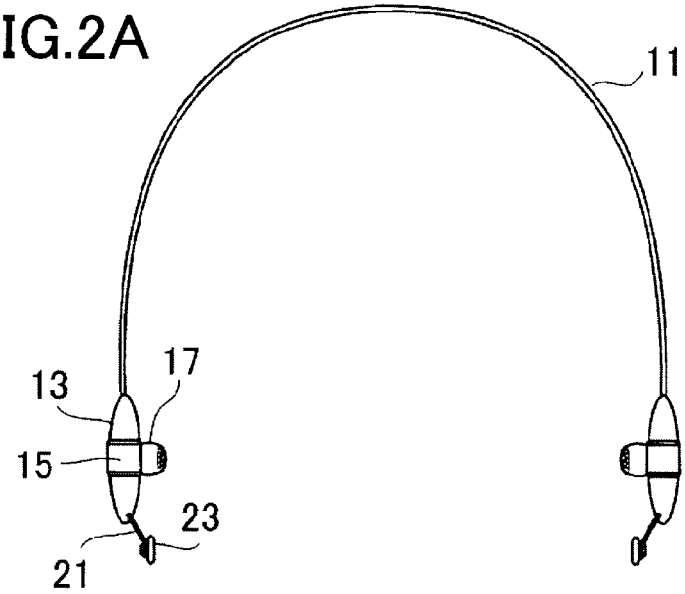
FIG. 2A to FIG. 2C are a front view, a side view, a partial bottom view of the headphones of FIG. 1, respectively.
Figure 2B:
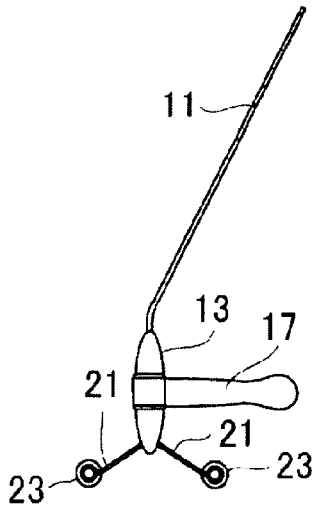
Figure 2C:
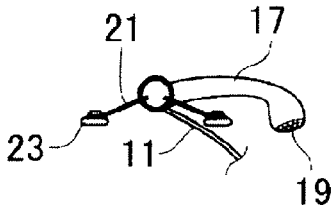
Figure 2D:
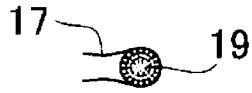
FIG. 2D is a front view of an earphone capsule section constituting a sound outputting section.

FIG. 1 is a perspective view of headphones according to a first embodiment of the present invention. FIGS. 2A~2C show these headphones from the front (FIG. 2A), from the side (FIG. 2B), and partially from below (FIG. 2C). FIG. 2D is a front view of an earphone capsule section of these headphones.

These headphones are centered around a frame 11, which is approximately U-shaped, and are laterally symmetrical in structure. The frame 11 may be made of metals, alloys, plastic or synthetic resins and the like, and is flexible, and when it is worn on the head and thus pushed outward during use, an inward force or lateral pressure to get back to its original state is at work. At both ends of the frame 11, a pair of earphone arm support sections 13 formed of a material such as plastic and the like are fixed in place. The earphone arm support sections 13 in this example are shaped like an elongated rugby ball, however, they are not limited to such a shape, and any arbitrary shape may be adopted so long as it does not get in the way in wearing the earphones or the headphones. A reception interface of an embodiment of the present invention may be wired or wireless. When adopting a wireless reception interface, it is possible to have the necessary electrical circuits built into the earphone arm support sections 13.

Almost to the center of the earphone arm support section 13, a base section 15 for an earphone arm 17 is provided so as to be rotatable. The earphone arm 17 protrudes outward from the base section 15, and comprises a material such as plastic, and an earphone capsule section 19 provided at the end of the earphone arm 17. The earphone capsule section 19 is sized and shaped so that it can be inserted in the ear. In this embodiment of the present invention, because the earphone arms 17 do not have to support and hold the headphones in place, the earphone capsule section 19 does not have to be tightly inserted in the ear as is necessary with conventional earphones, and thus need not be sized so that it fits in the ear tightly. From the tip of each earphone arm support section 13, two wire-like or rod-shaped support sections 21 protrude outward, and at the end of these support sections 21, paddings 23 are provided. The support sections 21 have an elasticity which, against up to a certain external force, will allow the support sections 21 to recover their original shape in reaction to deformation. The support sections 21 also have a plasticity which, against an external force exceeding a certain level, gives the support sections 21 a characteristic such that they do not recover their original shape in reaction to deformation. In order to achieve these qualities, the support sections 21 may comprise metals and alloys, for example. However, materials for the support sections 21 are not limited to these, and may comprise any arbitrary material which possesses the qualities mentioned above. The fine adjustment members according to some embodiments of the present invention comprise the support sections 21 described above, and by changing the shape of the support sections 21 according to the shape and size of the user's head, fine adjustments can be made to the lateral pressure exerted by the frame 11 during use, and the point of contact between the user's head and the paddings 23 can be altered. Thus, each individual user can obtain a comfortable fit according to his/her preferences.

For the paddings 23, materials such as silicone, synthetic rubber, plastic and the like may be considered. From the standpoint of providing a material that prevents slipping and is comfortable on the head surface, a flexible and soft material such as silicone is preferable. In this example, a structure wherein ends of the support sections 21 have a ring shape and paddings 23 are fitted thereon is shown. However, the attachment structure of the paddings 23 to the support sections 21 is not limited to this structure.

Figure 3:
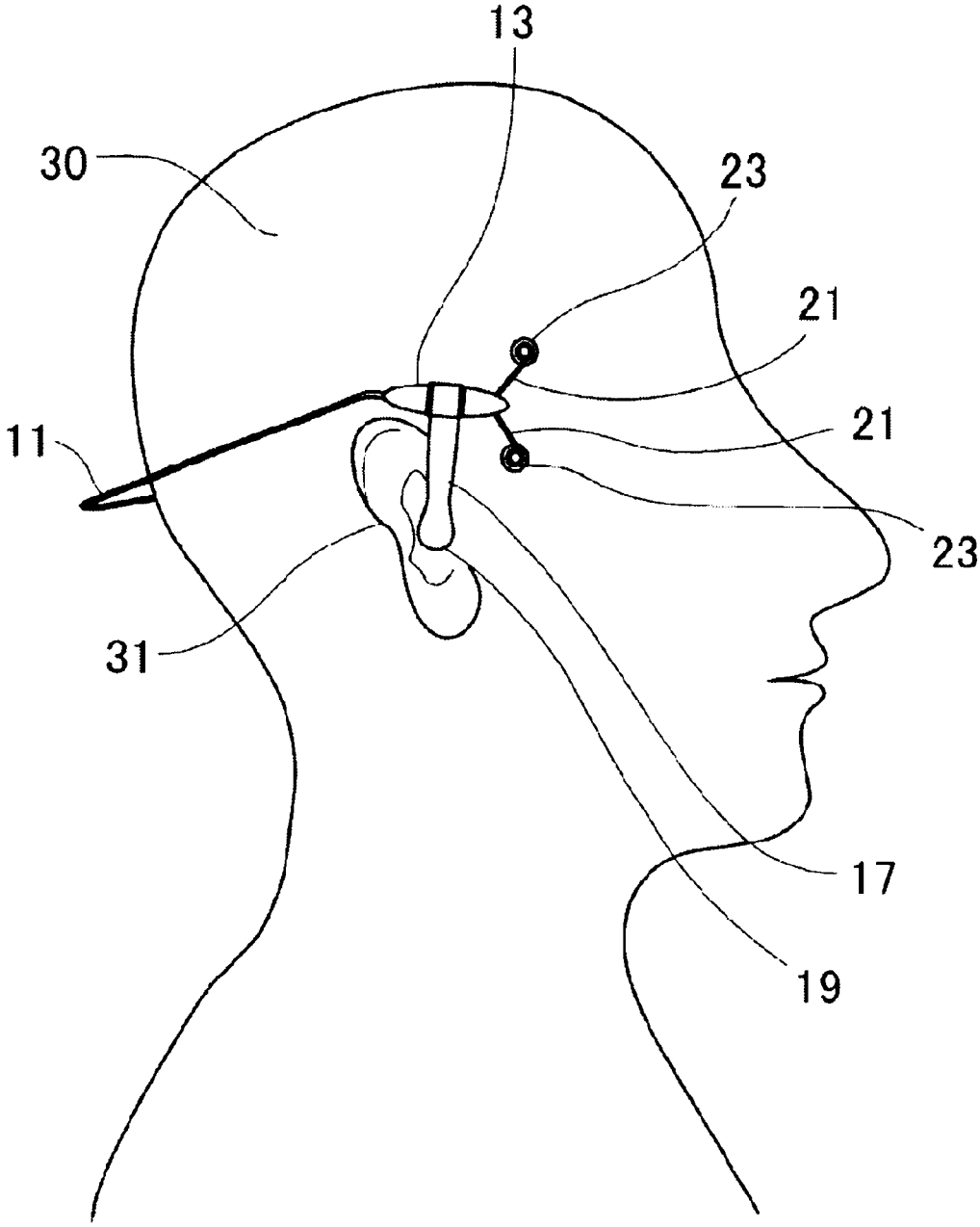
FIG. 3 shows the headphones of FIG. 1 as worn on the head.

FIG. 3 indicates these headphones as worn on a head 30. As can be seen in FIG. 2B, the headphones according to this embodiment of the present invention, when seen from the side, are structured in such a way that the frame 11 has a predetermined tilt relative to the length of the earphone arm support section 13. This is to achieve stability while the headphones are worn, and to position the frame 11 so that the ease of wearing of the headphones is hardly affected by the user's hairstyle. The earphone arm support sections 13 are positioned slightly away from the sides of the head 30, and may be worn without having them come into contact with the bases or pinnae of ears 31 of the user. Specifically because the earphone arm support sections 13 do not occupy the upper side of the bases of the ears, they do not obstruct the putting on or taking off of glasses.

Figure 4:
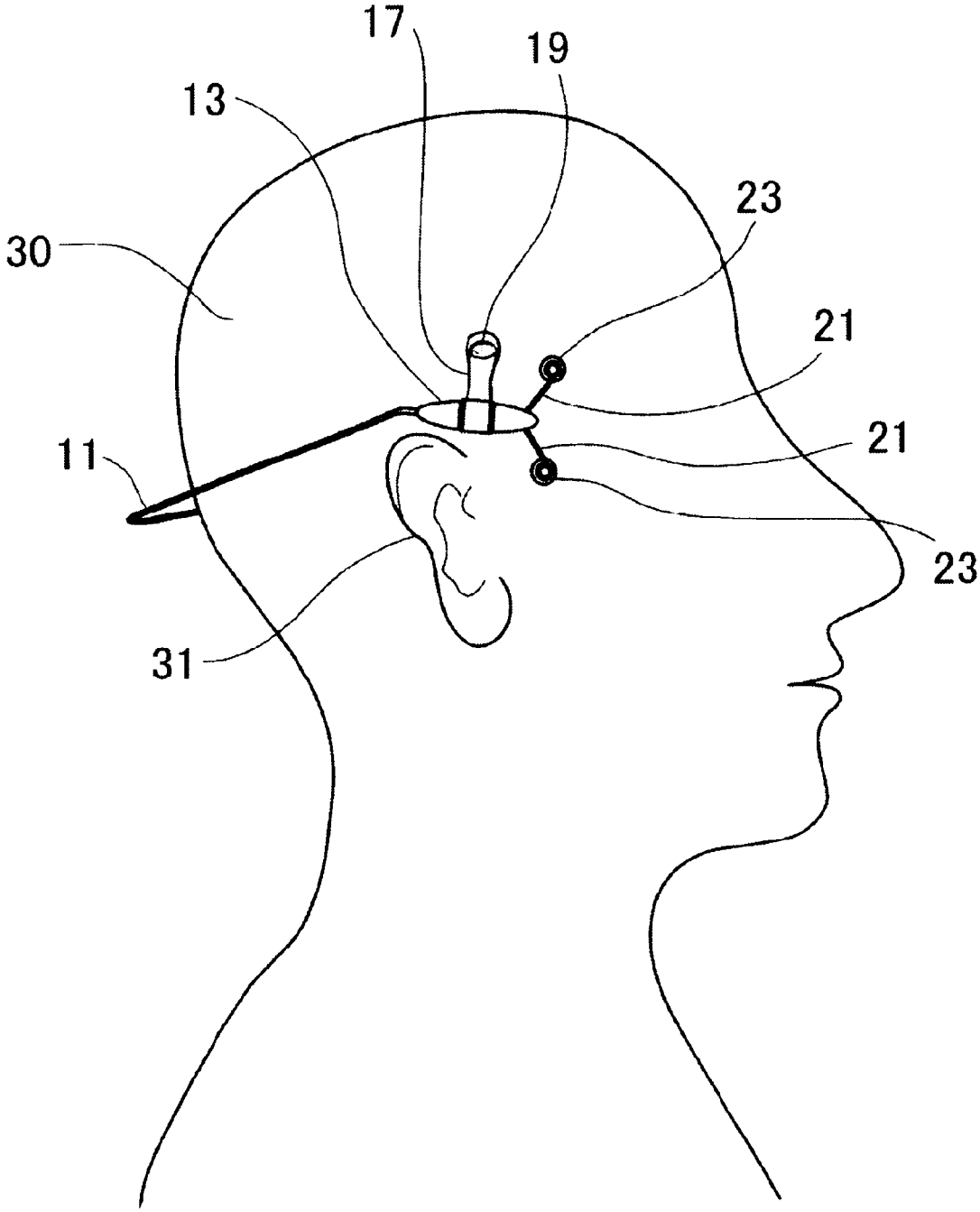
FIG. 4 shows a state where the user has temporarily released the earphone from the right ear during use as shown in FIG. 3.

FIG. 4 indicates the earphone temporarily released from the ear 31 (right ear) by the user while the headphones are worn as shown in FIG. 3. As can be seen in FIG. 4, the earphone arm 17 is rotated upward by way of an earphone moving structure with the earphone arm support section 13 at its center, while the headphones are worn on the head 30. Thus, releasing the earphone from one ear without having to remove the headphones entirely from the head 30 is made possible. The earphone arms 17 are locked at the rotated position by an earphone locking structure which is described later. Unlike conventional earphones, the removed earphone does not dangle on a cable, and therefore does not get in the way nor become caught in some object. Naturally, earphones may be released from both ears simultaneously while wearing the headphones.

Figure 5A:
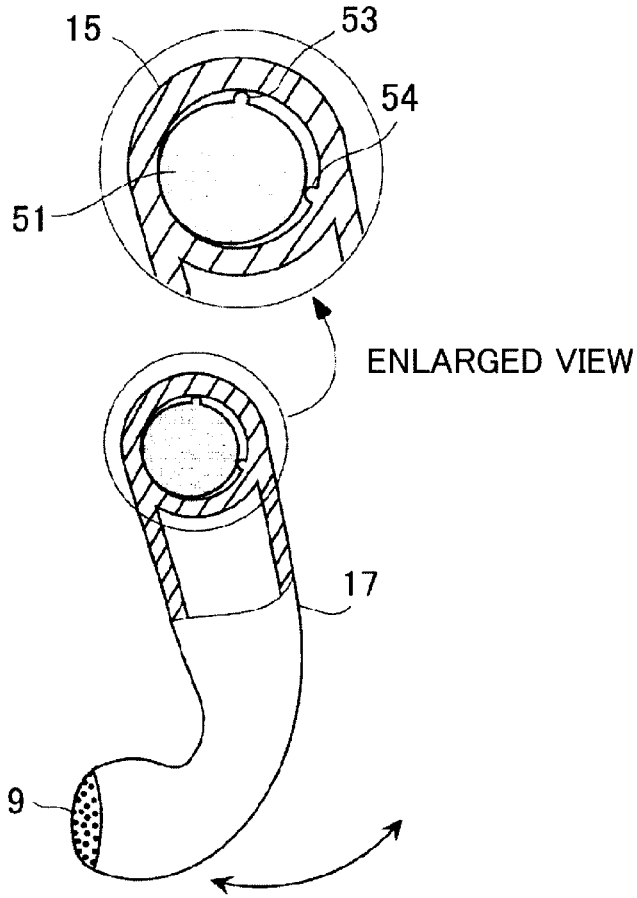
FIG. 5A and FIG. 5B are partial cross-sections of an earphone arm, and show an example of an earphone moving structure and an earphone locking structure according to the embodiment of FIG. 1.
Figure 5B:
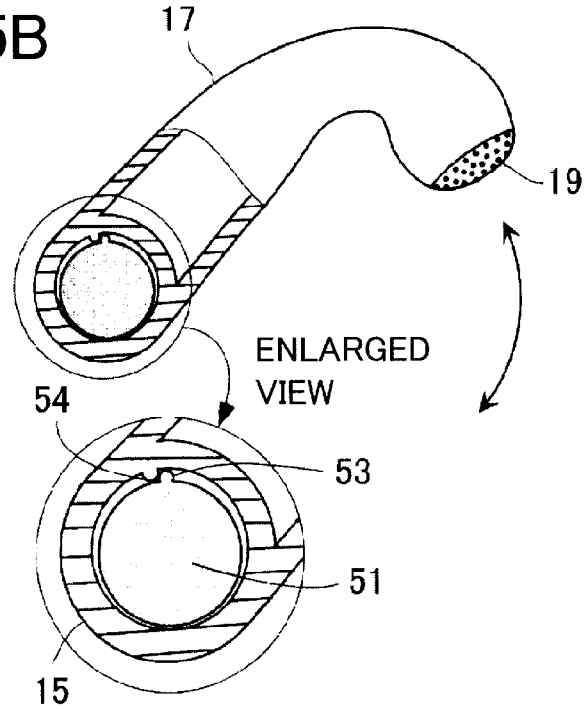

FIGS. 5A and 5B are partial cross-sectional views of the earphone arm 17, and indicate an example of the earphone moving structure and the earphone locking structure. FIG. 5A indicates these structures before locking, and FIG. 5B after locking. In this example, the base section 15 of the earphone arm 17 is shaped like a ring. A support axle 51 of the earphone arm support section 13 has a circular cross-section, and fits inside the base section 15. As such, the earphone arm 17 can rotate around the support axle 51 in response to an external force. On an upper side of the circumference of the support axle 51, a bump 53 is provided. There is also a bump 54 provided on the inner wall of the ring-shaped base section 15. FIG. 5A shows the earphone 19 at a first position as it is worn by the user, and as the earphone arm 17 is rotated anti-clockwise, in this drawing, and upward from this position, the bump 54 provided on the inner wall of the base section 15 slides over the circumference of the support axle 51, and meets the bump 53 of the support axle 51. When the earphone arm 17 is further rotated, the bump 54 rides over the bump 53. FIG. 5B shows this state. At this position, referred to as a second position, a clockwise, in this diagram, momentum is exerted on the earphone arm 17 due to gravity, but because the bump 53 and the bump 54 hit each other, the earphone arm 17 cannot rotate clockwise by itself and is thus held in place. When the user exerts a clockwise force on the earphone arm 17, the bump 54 rides over the bump 53, and the earphone capsule section can be worn in the ear again.

Figure 6A:
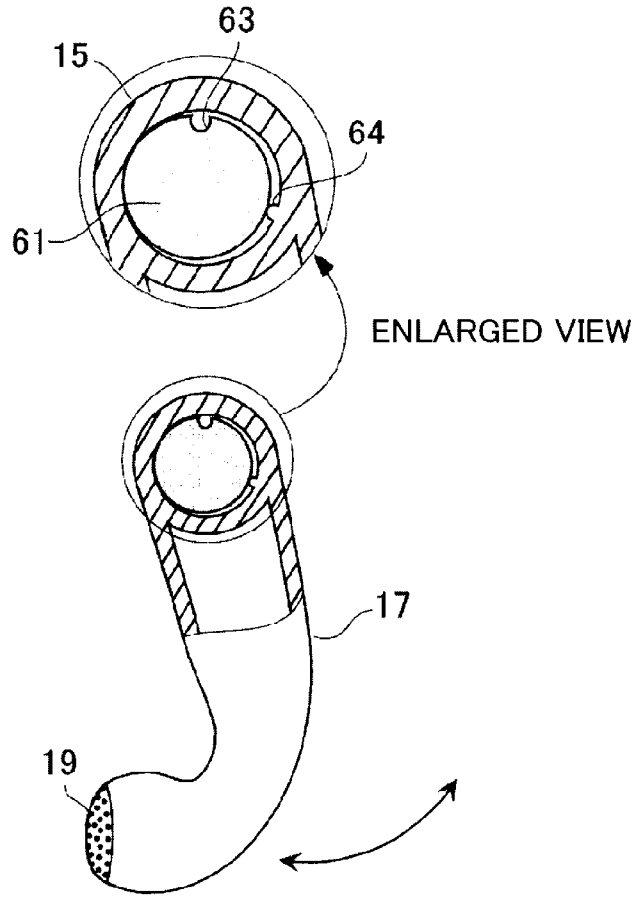
FIG. 6A and FIG. 6B are partial cross-sections of an earphone arm, and show another example of the earphone moving structure and the earphone locking structure.
Figure 6B:
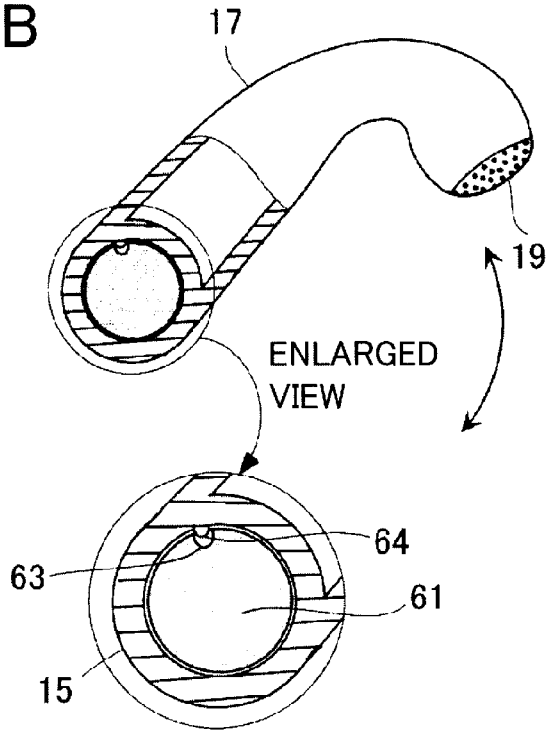

FIGS. 6A and 6B are partial cross-sectional views of the earphone arm 17 and show another example of the earphone moving structure and the earphone locking structure. FIG. 6A indicates these structures before locking, and FIG. 6B after locking. In this example, as shown partially enlarged, a dent 63 is provided, instead of the bump 53 as shown in FIG. 5, on the circumference of a support axle 61, similar to the support axle 51, and a bump 64 is shaped so as to fit inside the dent 63. When the earphone arm 17 is rotated from the position shown in FIG. 6A and the bump 64 reaches the dent 63, the bump 64 fits into the dent 63. Thus, rotation of the earphone arm 17 that would have otherwise been caused by gravity is prevented. When the user exerts an external force on the earphone arm 17 to cause rotation, the bump 64 is pulled out of the dent 63, and the earphone arm 17 once again becomes rotatable.

In addition, if the bump 54 or 64 is always in contact with the surface of the support axle 51 or 61, respectively, and friction alone can hold the earphone arm 17 still at an arbitrary position even in the absence of the bump 53 or the dent 63, the bump 53 and the dent 63 are not necessarily required. Also, in the examples described above, the bumps 54 and 64 are provided with the base section 15, and the bump 53 and the dent 63 are provided with the support axles 51 and 61 respectively, but these relationships may be reversed. Further, the bumps and dents provided with the support axles 51 and 61 and the base section 15 may be more than one.

Figure 7:
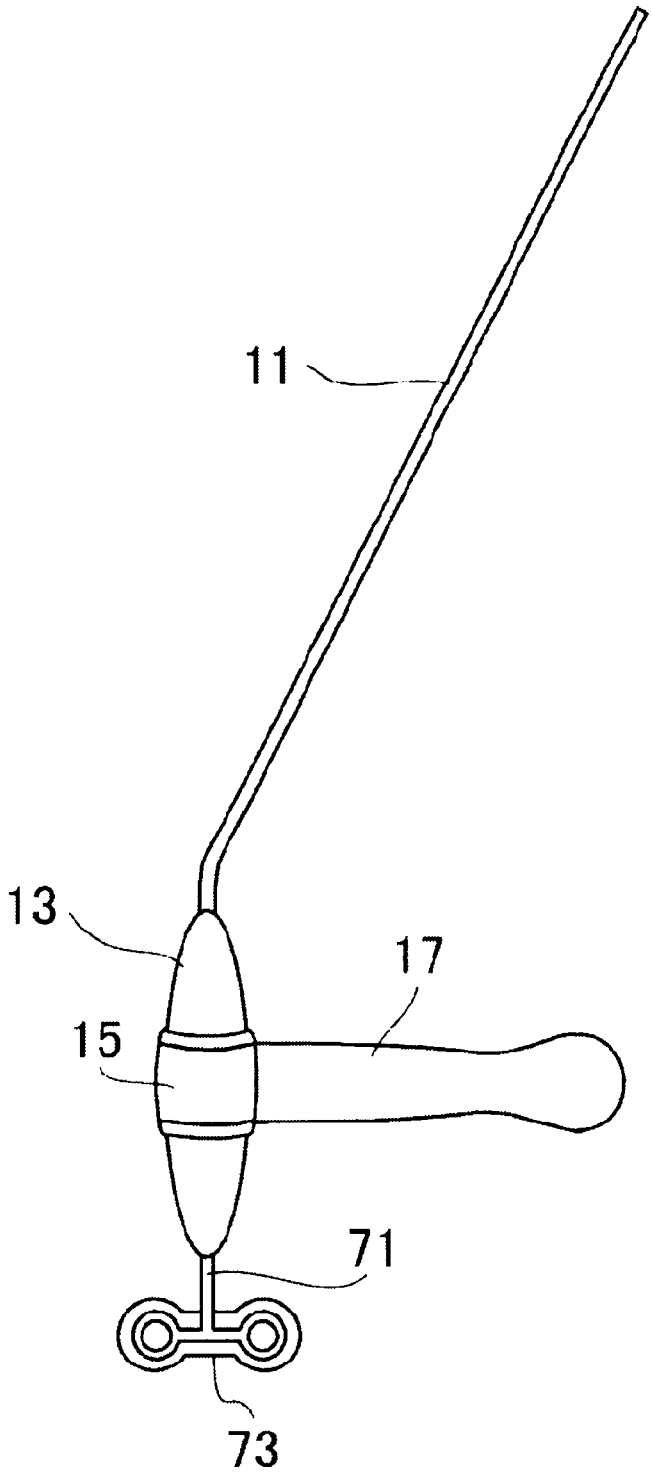
FIG. 7 is a side view of headphones according to a second embodiment of the present invention.

FIG. 7 is a side view of headphones according to a second embodiment of the present invention. Elements which are equivalent to those in the first embodiment are given the same reference numerals. The difference between the second embodiment and the first embodiment is in the structure of the fine adjustment member. In this embodiment, only one support section 71 protrudes from an end of the earphone arm support section 13, and an end of the support section 71 branches sideways and supports a padding 73 extended laterally. The support section 71 possesses flexibility and plasticity as with the support section 21 of the first embodiment. The material used for the padding 73 may be the same as those used for the padding 23 of the first embodiment.

The headphones according to the second embodiment can have fine adjustments made to the lateral pressure of the lateral pressure structure of the frame 11 by way of the fine adjustment members.

Figure 8:
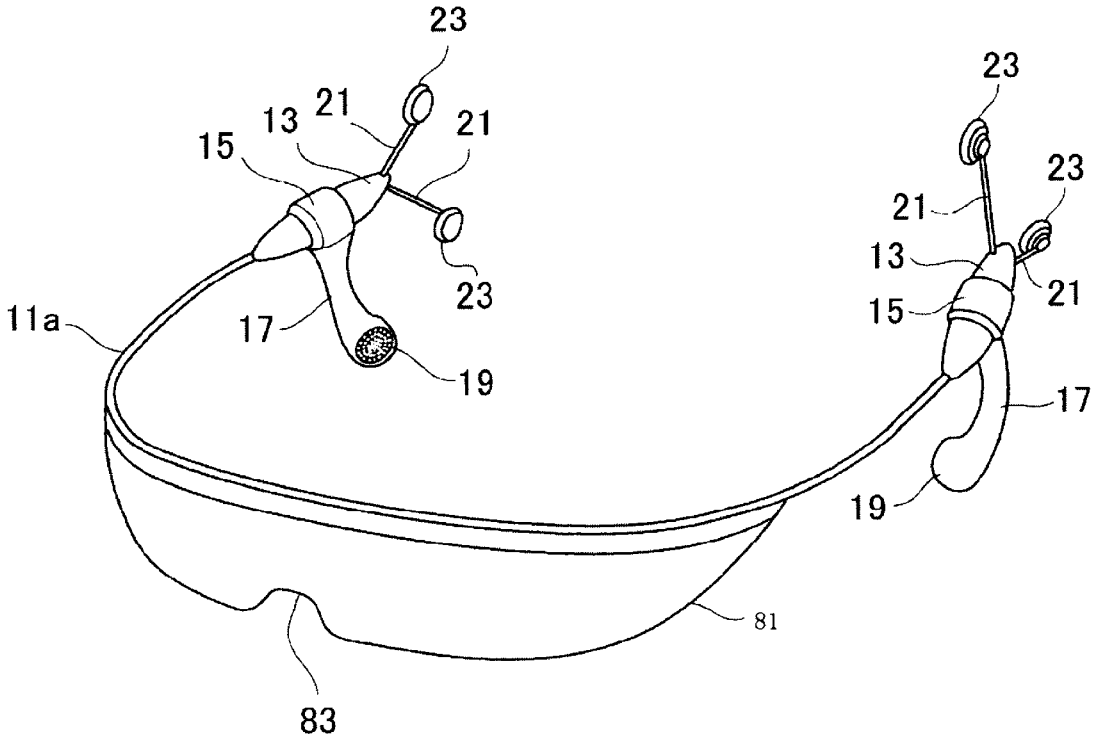
FIG. 8 is a perspective view of headphones according to a third embodiment of the present invention.

FIG. 8 is a perspective view of headphones according to a third embodiment of the present invention. In the previously described embodiments, the frame 11 is worn on the head at a position towards the back of the head. However, in the third embodiment, the support sections 21 as fine adjustment members and the paddings 23 come into contact with the head towards the back of the head unlike the previously described embodiments. Further, an eyeglass member 81 is attached to a frame 11*a*, and the frame 11*a* is supported by the user's nose by way of a nose rest section 83. Also, this eyeglass member 81 may be a simple optical component such as glass or plastic, or it may be a wearable terminal such as a display monitor.

As with the previous embodiments, the lateral pressure of the frame 11*a* can be adjusted by the fine adjustment members in the third embodiment also. Further, the earphone arms 17 are similarly rotatable.

It should be understood that the acoustic apparatus of the present invention is not limited to the description of the preferred embodiments herein, inasmuch as the present invention is capable of other embodiments and of being practiced or carried out in various ways, and that it is intended to cover all changes and modifications of the examples of the invention herein chosen for the purposes of the disclosure. Accordingly, any variations, combinations and sub-combinations of the present preferred embodiments should be permitted without departing from the technical scope of the invention. For example, in the embodiments described above, the earphone capsule sections 19 are provided on both ends of the frame 11, but the earphone capsule section 19 may be provided on just one end. In the embodiments described above, the length of the frame 11 is fixed, but an extension structure may be added to enable frame length adjustment.

What is claimed is:

1. An acoustic apparatus comprising:

a frame member forming a lateral pressure structure;

an adjustment member for performing adjustments to said lateral pressure structure provided on both ends of said frame member;

a padding member attached to said fine adjustment member;

a sound outputting structure attached to at least one end of said frame member comprising a sound outputting section moving structure enabling movement of said sound outputting section without having to move said frame member and said adjustment member, while wearing said acoustic apparatus on the head; said outputting structure further comprising a sound outputting section support section which supports said sound outputting section as to make said sound outputting section rotatable in relation to said frame member; and a sound outputting section locking structure which locks said sound outputting section at a second position rotated from a first position where said sound outputting section is worn close to a user's ear.

2. The acoustic apparatus according to claim 1, wherein said frame member is approximately U-shaped, and said adjustment member comprises at least one rod-shaped member having flexibility and plasticity, and one end of said rod-shaped member is joined to said frame member, and another end is joined to said padding member.

3. The acoustic apparatus according to claim 1, wherein said adjustment member comprises two rod-shaped members having flexibility and plasticity, and one end of said rod-shaped members is joined to said frame member, and another end of said rod-shaped members is joined to said padding member.

4. The acoustic apparatus according to claim 1, wherein said padding member comprises an elastic material.

5. The acoustic apparatus according to claim 1, further comprising an eyeglass member attached to said frame member, wherein said eyeglass member can rest on a user's nose.

* * * * *